US006713697B2

(12) United States Patent
Liu et al.

(10) Patent No.: US 6,713,697 B2
(45) Date of Patent: Mar. 30, 2004

(54) DUST AND MOISTURE FREE SWITCH

(75) Inventors: Chih Song Liu, Taoyuan (TW); Jui Jung Chiu, Taoyuan (TW)

(73) Assignee: Solteam Electronics Co., Ltd., Taoyuan (TW)

( * ) Notice: Subject to any disclaimer, the term of this patent is extended or adjusted under 35 U.S.C. 154(b) by 30 days.

(21) Appl. No.: 10/339,036

(22) Filed: Jan. 9, 2003

(65) Prior Publication Data

US 2003/0205449 A1 Nov. 6, 2003

(30) Foreign Application Priority Data

May 6, 2002 (TW) ..... 91206309 U

(51) Int. Cl.[7] ..... H01H 19/06
(52) U.S. Cl. ..... 200/302.3; 200/339
(58) Field of Search ..... 200/302.1–302.3, 200/315, 339

(56) References Cited

U.S. PATENT DOCUMENTS 4,218,602 A * 8/1980 Creech ..... 200/302.3
4,667,073 A * 5/1987 Osika ..... 200/317
4,937,407 A * 6/1990 Osika ..... 200/302.3
5,053,591 A * 10/1991 Theurer ..... 200/315
5,660,270 A * 8/1997 Martin et al. ..... 200/315
5,712,450 A * 1/1998 Chan et al. ..... 200/302.3 X
5,752,595 A * 5/1998 Fein et al. ..... 200/315
6,380,500 B1 * 4/2002 Lin ..... 200/302.3

* cited by examiner

*Primary Examiner*—James R. Scott
(74) *Attorney, Agent, or Firm*—Nelson A. Quintero

(57) ABSTRACT

A dust and moisture free switch includes a hollow casing, a contact pole device, a control plate and an isolation part. The contact pole device is inserted to the bottom of the casing with a stationary pole and a support pole being inserted into and locating at a respective pole hole and an arc pole being attached to the top of the support pole such that the arc pole can swing leftward and rightward. The control plate is joined to the upper portion of the casing and has the bottom thereof being arranged with a central hollow post to fit with an extensible stir lever, which has a bottom thereof contacting with the arc pole. The isolation part is made of soft high molecular plastic material and passed through by and fitting with the stir lever so as to be located at and closely joined to the inner wall of the casing to perform a function of blocking dust or moisture to enter the bottom of the casing. The stir lever can slide on the arc pole in case of an end of the control plate being pressed such that the arc pole can touch or detach from the stationary pole selectively to perform power on or off.

14 Claims, 2 Drawing Sheets

DUST AND MOISTURE FREE SWITCH

BACKGROUND OF THE INVENTION

1. Field of the Invention

The present invention relates to a dust and moisture free switch and, particularly, to a switch, which has an isolation part disposed between a control plate and a casing to prevent the dust or the moisture from disturbing the contact pole device at the bottom of the casing.

2. Description of Related Art

It is known that the switch has been used for years in the field of power supply as a required device for controlling the power on or off and avoiding accidents caused by continuing supplying the power. The switch usually can be classified into a constant on switch, which is off at the time of the current being not taken, and a constant off switch, which is on at the time of the current being taken. Thus, products powered by the electricity have provided with a switch and the basic principle for operating a switch is in that two electric poles are utilized to connect with each other as a close circuit for constituting a state of current taking and the two electric poles disconnect from each other as an open circuit to form a state of current not taking.

Generally, safety is also an important factor has to be considered in addition to an accurate operation of power on or power off. For instance, the switch has to be not leakage of electricity and not incorrect connection. Besides, the switch has to be free from dust or moisture in special locations such as a working environment with floating powder dust or heavy moisture such that it can prevent the contact pole device in the switch from short circuit or corrosion and prolong the life span of the switch. Currently, a treatment with regard to anti-dust or anti-moisture is done with a soft cover being attached to the top of the switch and a projecting rectangular frame enclosing the control plate thereof so as to conceal the switch at the top thereof. However, the efficiency of the wrap up type switch is in that both arc ends of the control plate just corresponds to both end edges of the rectangular frame so that it has to overcome a resistance force at each end edge due to the rectangular frame having a height during an operation of pressing and it is hard to operate smoothly. Besides, the wrap up type switch at the rectangular frame thereof is easy to result in breaking because of being repeatedly pressed and lose the function of ant-dust or anti-moisture.

SUMMARY OF THE INVENTION

The crux of the present invention is to provide a dust and moisture free switch, which includes a hollow casing, a contact pole device, a control plate and an isolation part. The contact pole device is inserted to the bottom of the casing with a stationary pole and a support pole being inserted into and locating at a respective pole hole and an arc pole being attached to the top of the support pole such that the arc pole can swing leftward and rightward. The control plate is joined to the upper portion of the casing and has the bottom thereof being arranged with a central hollow post to fit with an extensible stir lever, which has a bottom thereof contacting with the arc pole. The isolation part is made of soft high molecular plastic material and passed through by and fitting with the stir lever so as to be located at and closely joined to the inner wall of the casing to perform a function of blocking dust or moisture to enter the bottom of the casing. The stir lever can slide on the arc pole in case of an end of the control plate being pressed such that the arc pole can touch or detach from the stationary pole selectively to perform power on or off.

BRIEF DESCRIPTION OF THE DRAWINGS

The present invention can be more fully understood by reference to the following description and accompanying drawings, in which:

FIG. 3 is a sectional view similar to FIG. 2 illustrating the switch being in a state of on.

DETAILED DESCRIPTION OF THE PREFERRED EMBODIMENT

Figure 1:
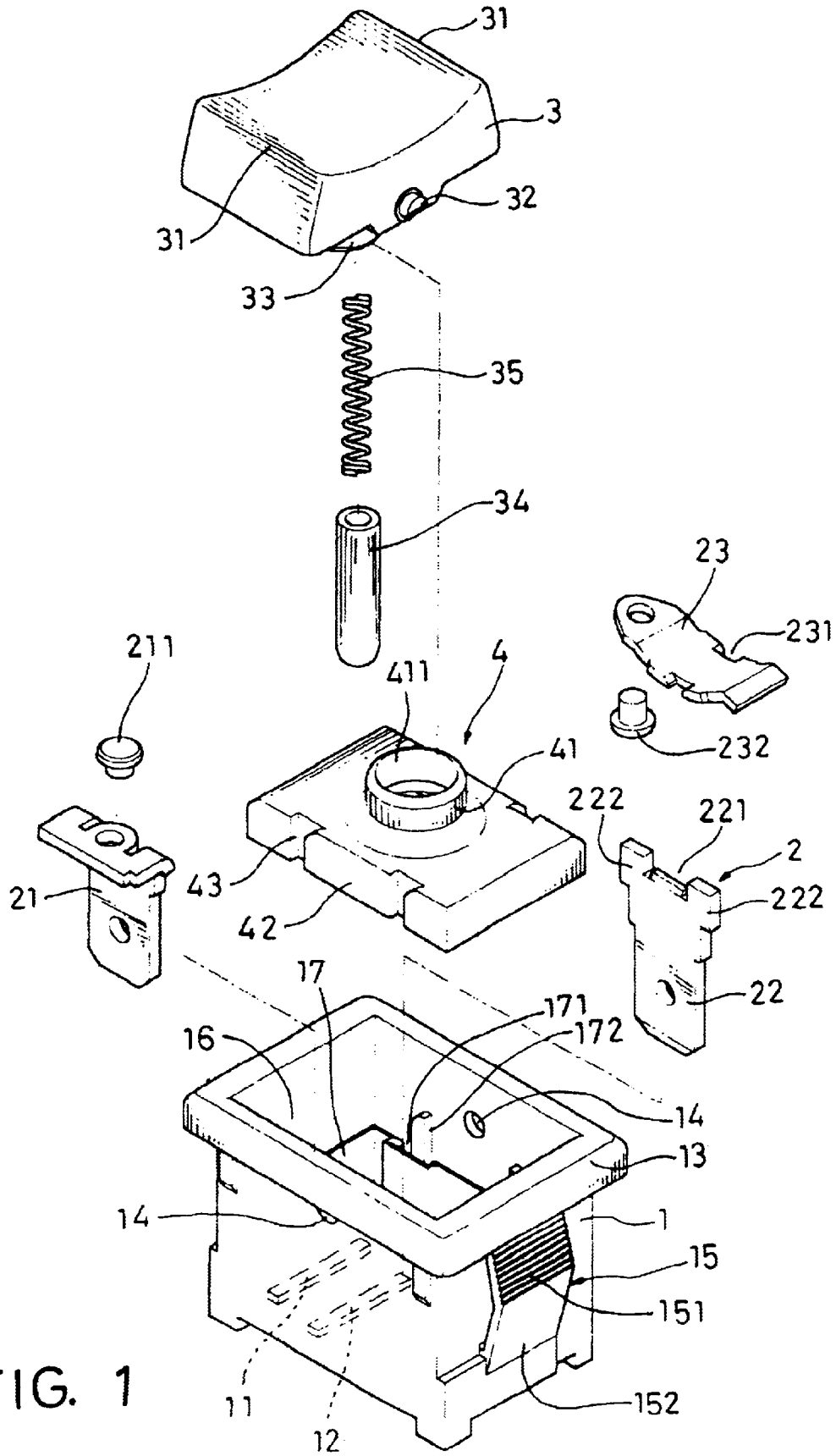
FIG. 1 is an exploded perspective view of a dust or moisture free switch according to the present invention.

Referring to FIG. 1, basically, a dust or moisture free switch according to the present invention includes a casing 1, a contact pole device 2, a control plate 3 and an isolation part 4.

Wherein, the casing 1 is a hollow base with two pole holes 11, 12 at the bottom thereof for being inserted and locating the contact pole device 2. The casing 1 at the top thereof extends a casing frame 13 as a stopper while the contact pole device 2 is inserted into preset holes of an electric appliance. In order to be capable of joining and locating the control plate 3 easily, the casing 1 at the front and the rear sides thereof has an axial hole 14 respectively to be disposed oppositely and at the left and right sides thereof has a bow-shaped elastic lock 15 respectively to be disposed oppositely. The elastic lock 15 at the upper bent half thereof is a transverse track section 151 and at the lower bent half thereof is a flat section 152 such that the flat section 152 provides a guide function and the transverse track section 151 can perform an engaging function with the respective rim of the preset holes in the electric appliance as soon as the elastic lock 15 is inserted into the preset holes. The casing 1 at the inner wall surface 16 thereof has a middle spacing wall 17 so that a wall gap 171 can be formed between the inner wall surface 16 and the middle spacing wall 17 for locating the isolation part 4. Thus, a plurality of vertical locating ribs 172 are arranged between the inner wall surface 16 and the spacing wall 17.

The contact pole device 2 is prior art and has a stationary pole 21 inserted in the pole hole 11 and a support pole 22 inserted in another pole 12. Further, an arc pole 23 is crossly inserted in the recess opening 221 of the support pole 22 such that two opposite engaging recesses 231 at the middle of the arc pole 23 engage with the recess opening 221. Hence, the arc pole 23 can perform a leverage movement on the support pole 22 so that a movable joint 232 of the arc pole 23 can selectively touch or detach from a fixed joint 211 at the top of the stationary pole 21 to perform power on or off.

The control plate 3 at the top thereof has a curve plane between two lateral sides 31 thereof and provides with two opposite juts 32 corresponding to the two axial holes 14 and the control plate 3 can swing leftward and rightward with respect to the casing 1 to facilitate pressing once the juts 32 engage with the axial holes 14. The control plate 3 at the bottom thereof has a central hollow post 33 for receiving and locating an extensible stir lever 34 and, for instance, a spring 35 can be disposed between the hollow post 33 and the stir lever 34 to allow the stir lever 34 contacting with the arc pole 23 constantly such that the stir lever 34 moves with the control plate 3 to actuate the arc pole 23 for controlling the power on/off. Besides, the hollow post 33 has a lever ring 36 additionally with a ring clearance 361 in between.

The isolation part 4 is a plate made of high molecular plastic material such as PVC and at the center thereof protrudes a fitting ring 41 corresponding to the ring clearance 361 such that the fitting ring 41 can be inserted into the ring clearance 361. The stir lever 34 is arranged to pass through a ring hole 411 of the fitting ring 41 and the periphery of the isolation part 4 has a joining edge 42 and engaging recesses 43 corresponding to the clearance 171 and locating ribs 172 respectively for being able to engage with each other so that the upper side of the contact pole device 2 can be covered in the casing 1 to prevent the dirt and the moisture from entering the bottom of the casing 1. Therefore, it is possible to obtain a dust and moisture free effect.

Figure 3:
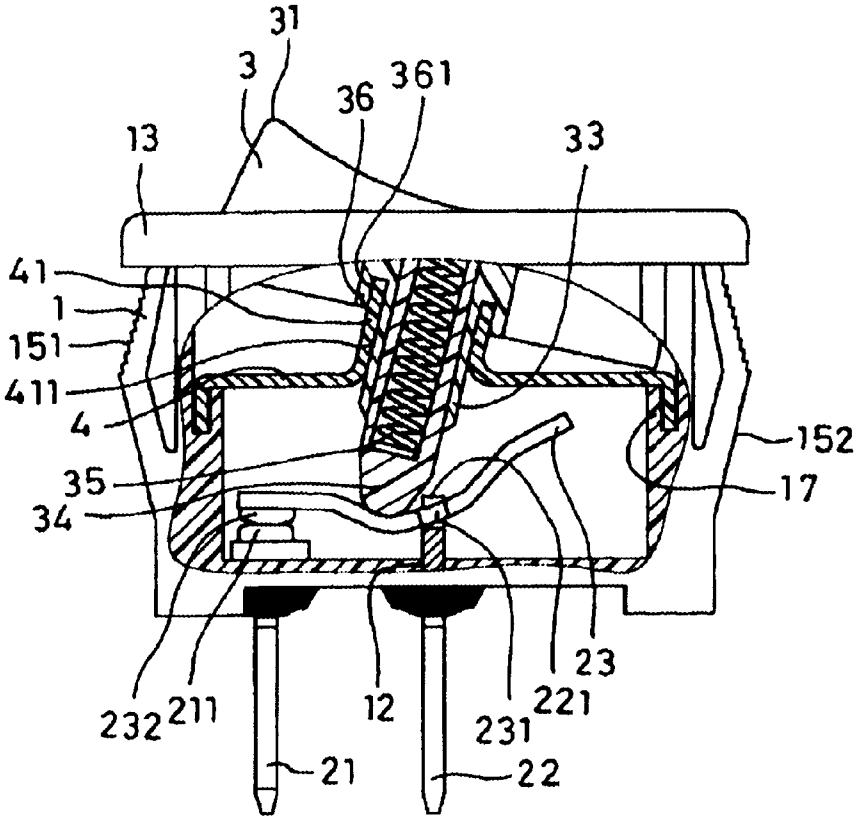
Figure 2:
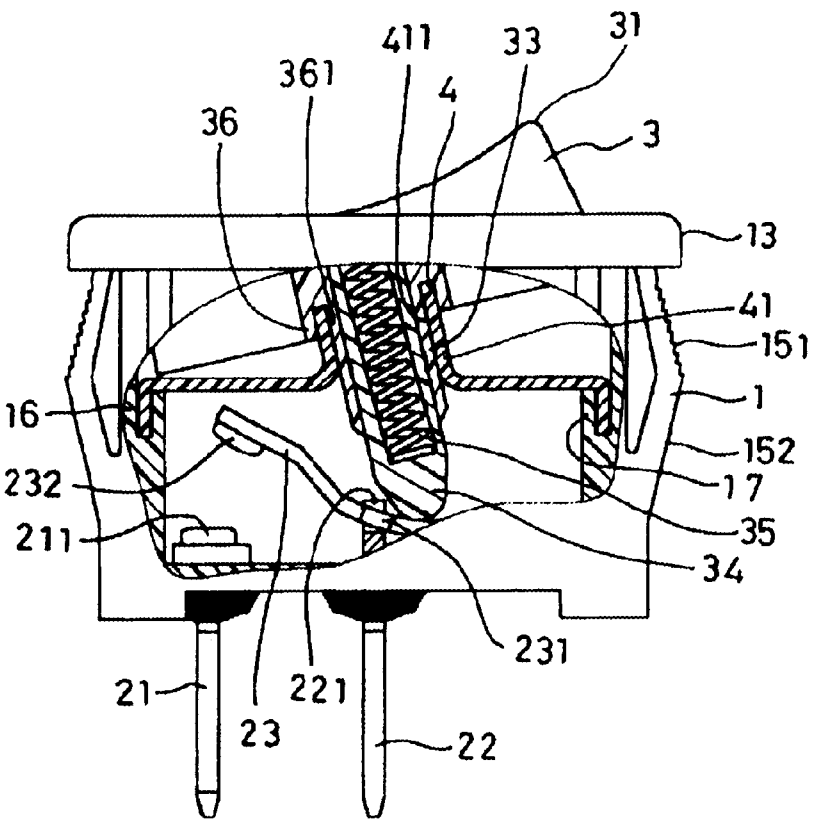
FIG. 2 is a sectional view of the switch according to the present invention illustrating the switch being in a state of off.

Referring to FIGS. 2 and 3, while the switch of the present invention is in use, the only thing has to be done is to press the control plate 3 and then the contact pole device 2 can move relatively in the casing 1 to actuate the power on or off. The isolation part 4 is located between the control plate 3 and the casing 1 to keep the dirt and the moisture out of the bottom of the casing so as not to influence the normal function of the contact pole device 2.

It is appreciated that the isolation part in the switch of the present invention is fixedly disposed between the control plate and the casing so that the control plate can be free from being disturbed during the operation of pressing. Further, the fitting ring of the isolation part can be actuated synchronously with the stir lever to avoid break resulting from repeated operations so that it is possible to extend the life span of the switch.

While the invention has been described with reference to the a preferred embodiment thereof, it is to be understood that modifications or variations may be easily made without departing from the spirit of this invention, which is defined by the appended claims.

What is claimed is:

1. A dust and moisture free switch, comprising:

a hollow casing, having a bottom and an upper portion;

a contact pole device, being inserted to the bottom of the casing, having a stationary pole and a support pole being inserted into and locating at a respective pole hole and having an arc pole attached to a top of the support pole such that the arc pole can swing leftward and rightward;

a control plate, being joined to the upper portion of the casing, having a bottom thereof arranged a central hollow post to fit with an extensible stir lever, which has a bottom thereof contacting with the arc pole; and an isolation part, being made of soft high molecular plastic material, being passed through by fitting with the stir lever and being located at and closely joined to the casing at an inner wall thereof to perform a function of blocking dust or moisture to enter the bottom of the casing;

wherein the casing at an inner wall thereof protrudes a spacing wall with a gap in between and the isolation part at a periphery thereof extends downward a joining edge being inserted into the gap to form a close joint;

whereby, the stir lever can slide on the arc pole in case of an end of the control plate being pressed such that the arc pole can touch or detach from the stationary pole selectively to open or close a circuit.

2. The dust and moisture free switch defined in claim 1, wherein the casing at two lateral sides thereof has a bow-shaped elastic lock for facilitating engaging and locating.

3. The dust and moisture free switch as defined in claim 1 wherein the elastic lock at the upper portion thereof is an engaging track section and at a lower portion thereof is a flat section.

4. The dust and moisture free switch as defined in claim 1, wherein the a plurality of locating ribs are arranged between the inner wall and the spacing wall and the isolation part at the joining edge thereof has a plurality of engaging recesses corresponding to the locating ribs for accommodating to each other.

5. The dust and moisture free switch as defined in claim 1, wherein a spring is disposed between the hollow post and the stir lever.

6. The dust and moisture free switch, as defined in claim 1, wherein the hollow post is surrounded with a lever ring defining a ring clearance and the isolation part at a top thereof projects a fitting ring corresponding to the ring clearance so as to be inserted into the ring clearance with a ring hole of the fitting ring being passed through with the stir lever.

7. The dust and moisture free switch as defined in claim 1, wherein the soft high molecular plastic material is PVC.

8. A dust and moisture free switch, comprising:

a hollow casing, having a bottom and an upper portion;

a contact pole device, being inserted to the bottom of the casing, having a stationary pole and a support pole being inserted into and locating at a respective pole hole and having an arc pole attached to a top of the support pole such that the arc pole can swing leftward and rightward;

a control plate, being joined to the upper portion of the casing, having a bottom thereof arranged a central hollow post to fit with an extensible stir lever, which has a bottom thereof contacting with the arc pole; and an isolation part, being made of soft high molecular plastic material, being passed through by fitting with the stir lever and being located at and closely joined to the casing at an inner wall thereof to perform a function of blocking dust or moisture to enter the bottom of the casing;

wherein the hollow post is surrounded with a lever ring defining a ring clearance and the isolation part at a top thereof projects a fitting ring corresponding to the ring clearance so as to be inserted into the ring clearance with a ring hole of the fitting ring being passed through with the stir lever;

whereby, the stir lever can slide on the arc pole in case of an end of the control plate being pressed such that the arc pole can touch or detach from the stationary pole selectively to open or close a circuit.

9. The dust and moisture free switch defined in claim 8, wherein the casing at two lateral sides thereof has a bow-shaped elastic lock for facilitating engaging and locating.

10. The dust and moisture free switch as defined in claim 8, wherein the elastic lock at an upper portion thereof is an engaging track section and at a lower portion thereof is a flat section.

11. The dust and moisture free switch as defined in claim 8, wherein the casing at an inner wall thereof protrudes a spacing wall with a gap in between and the isolation part at a periphery thereof extends downward a joining edge being inserted into the gap to form a close joint.

12. The dust and moisture free switch as defined in claim 11, wherein a plurality of locating ribs are arranged between the inner wall and the spacing wall and the isolation part at the joining edge thereof has a plurality of engaging recesses corresponding to the locating ribs for accommodating to each other.

13. The dust and moisture free switch as defined in claim 8, wherein a spring is disposed between the hollow post and the stir lever.

14. The dust and moisture free switch as defined in claim 8, wherein the soft high molecular plastic material is PVC.

* * * * *